US011353301B2

(12) United States Patent
Nguyen et al.

(10) Patent No.: US 11,353,301 B2
(45) Date of Patent: Jun. 7, 2022

(54) KINETIC ENERGY VEHICLE WITH ATTITUDE CONTROL SYSTEM HAVING PAIRED THRUSTERS

(71) Applicant: Raytheon Company, Waltham, MA (US)

(72) Inventors: Huy P. Nguyen, Tucson, AZ (US); Rob J. Fuentes, Tucson, AZ (US); Michael Schmidt, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 193 days.

(21) Appl. No.: 16/749,324

(22) Filed: Jan. 22, 2020

(65) Prior Publication Data

US 2021/0223011 A1 Jul. 22, 2021

(51) Int. Cl.
*F42B 10/66* (2006.01)

(52) U.S. Cl.
CPC ..... *F42B 10/663* (2013.01)

(58) Field of Classification Search
CPC ..... F42B 10/663
See application file for complete search history.

(56) References Cited

U.S. PATENT DOCUMENTS 5,452,869 A 9/1995 Basuthakur
6,695,251 B2 * 2/2004 Rodden ..... G05D 1/107 244/164
7,012,233 B2 3/2006 Brown
7,494,090 B2 * 2/2009 Leal ..... F41G 3/04 244/3.16
7,509,796 B2 3/2009 Hansen
8,084,724 B1 12/2011 Brosch
8,242,422 B2 * 8/2012 Olden ..... F42B 10/661 244/3.1
8,436,283 B1 * 5/2013 Tournes ..... F41G 7/2293 244/3.15
9,068,808 B2 * 6/2015 Morgan ..... F42B 10/663
9,377,279 B2 * 6/2016 Facciano ..... F42B 15/01
9,429,105 B2 8/2016 Barker
10,371,495 B2 8/2019 Kahana
2014/0360157 A1 * 12/2014 Barker ..... F02K 9/80 60/204

* cited by examiner

*Primary Examiner* — Justin M Benedik

(74) *Attorney, Agent, or Firm* — Renner, Otto, Boisselle & Sklar, LLP

(57) ABSTRACT

A kinetic energy vehicle (or warhead) has a divert thruster system and an attitude control system, both operatively coupled to receive pressurized gasses from a solid rocket motor that is operatively coupled to both systems. The attitude control system may have two pairs of attitude control thrusters, with one of the pairs diametrically opposed from the other pair, on opposite sides of an end (such as a rear end) of the vehicle. The attitude control thrusters all have radial and circumferential components to their thrust, and various combinations of the attitude control thrusters may be used to achieve desired roll, pitch, and/or yaw.

20 Claims, 10 Drawing Sheets

KINETIC ENERGY VEHICLE WITH ATTITUDE CONTROL SYSTEM HAVING PAIRED THRUSTERS

GOVERNMENT RIGHTS

This invention was made with United States Government support under Contract Number HQ0276-10-C-0005, awarded by the United States Department of Defense. The government has certain rights in the invention.

FIELD OF THE INVENTION

The invention is in the field of flying vehicles with attitude control systems having thrusters.

DESCRIPTION OF THE RELATED ART

Kinetic energy vehicles are used to engage and destroy certain targets, such as long-range ballistic missiles. Such vehicles travel at high speeds and use their impact with the target to destroy the target or divert the target off course. Kinetic energy vehicles generally have course correction mechanisms to allow adjustments in flight to track and collide with the target. Improvements in such course correction mechanisms, such as thruster systems, are desirable.

SUMMARY OF THE INVENTION

A kinetic energy vehicle has a divert thruster system with three thrusters circumferentially evenly spaced around a perimeter of the vehicle. The three thrusters are configured to translationally divert the vehicle in any direction perpendicular to a longitudinal axis of the vehicle, by firing one or a combination of the thrusters, depending on the desired direction of the translation.

A kinetic energy vehicle has attitude control thrusters in a bowtie configuration, with two pairs of thrusters diametrically opposed to one another. Various combinations of the thrusters may be actuated to achieve attitude change in desired roll, pitch, and/or yaw directions.

According to an aspect of the invention, a kinetic energy vehicle includes: a solid rocket motor; a divert thruster system; and an attitude control system; wherein the divert thruster system and the attitude control system are operatively coupled to the solid rocket motor to receive pressurized gasses output by the solid rocket motor; and wherein the attitude control system includes two pairs of attitude control thrusters, with one pair diametrically opposed to the other pair, and with the attitude control thrusters of each pair having radial thrust components in an outward radial direction and circumferential thrust components in opposite circumferential directions.

According to an embodiment of any paragraph(s) of this summary, each of the attitude control thrusters have a nonzero radial component of thrust and a nonzero circumferential component of thrust.

According to an embodiment of any paragraph(s) of this summary, for each of the attitude control thrusters the circumferential component of thrust is greater than the radial component of thrust.

According to an embodiment of any paragraph(s) of this summary, the divert thruster system includes three divert thrusters circumferentially substantially evenly spaced about a perimeter of the vehicle.

According to an embodiment of any paragraph(s) of this summary, the divert thruster system includes divert thrusters located longitudinally substantially at a center of gravity of the vehicle.

According to an embodiment of any paragraph(s) of this summary, the vehicle further includes an axially-aligned thruster operatively coupled to the solid rocket motor to receive pressurized gasses output by the solid rocket motor.

According to an embodiment of any paragraph(s) of this summary, the axially-aligned nozzle is coincident with a central longitudinal axis of the kinetic energy vehicle.

According to an embodiment of any paragraph(s) of this summary, the vehicle further includes a control loop operatively coupled to the divert thruster system and the attitude control system.

According to an embodiment of any paragraph(s) of this summary, the control loop provides commands regarding the thrust needed at the attitude control thrusters and at divert thrusters of the divert thruster system.

According to an embodiment of any paragraph(s) of this summary, the control loop includes a mixing/limiting logic block that receives input from an autopilot, from a guidance system, and from an attitude control block.

According to an embodiment of any paragraph(s) of this summary, a first flow passage provides pressurized gas from the solid rocket motor to the attitude control thrusters of one of the pairs of attitude control thrusters.

According to an embodiment of any paragraph(s) of this summary, a second flow passage provides pressurized gas from the solid rocket motor to the attitude control thrusters of another of the pairs of attitude control thrusters.

According to an embodiment of any paragraph(s) of this summary, the first flow passage provides pressurized gas to a first manifold that is mechanically coupled to the attitude control thrusters of the one of the pairs of attitude control thrusters.

According to an embodiment of any paragraph(s) of this summary, the second flow passage provides pressurized gas to a second manifold that is mechanically coupled to the attitude control thrusters of the another of the pairs of attitude control thrusters.

According to an embodiment of any paragraph(s) of this summary, the vehicle further includes a sensor operatively coupled to the divert thruster system and the attitude control system.

According to an embodiment of any paragraph(s) of this summary, the sensor is an electro-optical/infra-red (EO/IR) sensor.

According to another aspect of the invention a kinetic energy vehicle includes: a solid rocket motor; a divert thruster system; and an attitude control system; wherein the divert thruster system is operatively coupled to the solid rocket motor to receive pressurized gasses output by the solid rocket motor; and wherein the divert thruster system includes three divert thrusters circumferentially substantially evenly spaced about a perimeter of the vehicle.

According to an embodiment of any paragraph(s) of this summary, the vehicle further includes an attitude control system operatively coupled to the solid rocket motor to receive pressurized gasses output by the solid rocket motor.

According to an embodiment of any paragraph(s) of this summary, the attitude control system includes two pairs attitude of control thrusters, with one pair diametrically opposed to the other pair, and with the attitude control thrusters each pair having substantially similar radial thrust components and opposite circumferential components.

According to a further aspect of the invention, a method of controlling course and orientation of a kinetic energy vehicle includes: during flight of the kinetic energy vehicle: burning a solid rocket motor to produce pressurized gasses; providing axial propulsive thrust using some of the pressurized gasses; selectively translationally moving the kinetic energy vehicle using a divert thruster system of the kinetic energy vehicle that receives some of the pressurized gasses from the solid rocket motor; and selectively adjusting orientation of the kinetic energy vehicle using an attitude control system of the kinetic energy vehicle that receives some of the pressurized gasses from the solid rocket motor.

According to an embodiment of any paragraph(s) of this summary, the providing axial propulsive thrust includes selectively providing the axial propulsive thrust as desired.

According to a still further aspect of the invention, a method of flying a kinetic energy vehicle includes the steps of: launching the kinetic energy vehicle; and adjusting orientation by selectively actuating attitude control thrusters of kinetic energy vehicle to produce pitch, yaw, and roll moments; wherein the attitude control thrusters are in two pairs of attitude control thrusters, with one pair diametrically opposed to the other pair, and with the attitude control thrusters each pair having radial thrust components in an outward radial direction and circumferential thrust components in opposite circumferential directions.

According to an embodiment of any paragraph(s) of this summary, the adjusting orientation includes providing pressurized gasses from a solid rocket motor of the vehicle to one of the pairs of attitude control thrusters through a first flow passage, and providing pressurized gasses from the solid rocket motor to another of the pairs of attitude control thrusters through a second flow passage.

According to an embodiment of any paragraph(s) of this summary, the method further includes translating the vehicle during flight using divert thrusters of a divert thruster system of the vehicle.

According to an embodiment of any paragraph(s) of this summary, the divert thruster system includes three divert thrusters circumferentially substantially evenly spaced about a perimeter of the vehicle; and the translating includes rolling the vehicle to position one of the divert thrusters to a desired translation direction.

According to another aspect of the invention, a kinetic energy vehicle includes: a solid rocket motor; and a divert thruster system; wherein the divert thruster system is operatively coupled to the solid rocket motor to receive pressurized gasses output by the solid rocket motor; and wherein the divert thruster system includes three divert thrusters circumferentially substantially evenly spaced about a perimeter of the vehicle.

According to an embodiment of any paragraph(s) of this summary, the vehicle further includes a controller operatively coupled to both the attitude control system and the divert thrusters.

According to an embodiment of any paragraph(s) of this summary, the operatively configured to roll the vehicle to a desired configuration for firing one or more of the divert thrusters, for achieving desired translation of the vehicle.

According to an embodiment of any paragraph(s) of this summary, the controller is operatively configured to roll the vehicle to a desired configuration for firing one or more of the divert thrusters, for achieving desired translation of the vehicle.

According to yet another aspect of the invention, a method of flying a kinetic energy vehicle includes the steps of: launching the kinetic energy vehicle; and translating the vehicle using three divert thrusters of a divert thruster system of the kinetic energy vehicle, where the three divert thrusters are circumferentially substantially evenly spaced about a perimeter of the vehicle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A kinetic energy vehicle (or warhead) has a divert thruster system and an attitude control system, both operatively coupled to receive pressurized gasses from a solid rocket motor that is operatively coupled to both systems. The attitude control system may have two pairs of attitude control thrusters, with one of the pairs diametrically opposed from the other pair, on opposite sides of an end (such as a rear end) of the vehicle. The attitude control thrusters all have radial and circumferential components to their thrust, and various combinations of the attitude control thrusters may be used to achieve desired roll, pitch, and/or yaw. The divert thruster system may have three divert thrusters evenly spaced around a circumference of the vehicle, offset 120 degrees from each other. The divert thrusters are located at a longitudinal (axial) location along the vehicle at or close to a center of gravity of the vehicle. Various of the divert thrusters (singularly or in combinations) may be fired (pressurized gas from the solid rocket motor emitted by the divert thruster(s)) to achieve desired translation of the kinetic energy vehicle. The vehicle may also have an axial nozzle that receives pressurized gasses from the solid rocket motor, configured to provide additional thrust to the vehicle.

Much of the control system for operating the thrusters may be the same as that for a legacy vehicle using a more traditional cruciform divert thruster configuration, and a six-thruster H-shape attitude control configuration, with items such as an autopilot unchanged. A mixing/limiting logic block can be used to handle the change in configuration to a three-thruster divert system and a bowtie configuration attitude control system.

Figure 1:
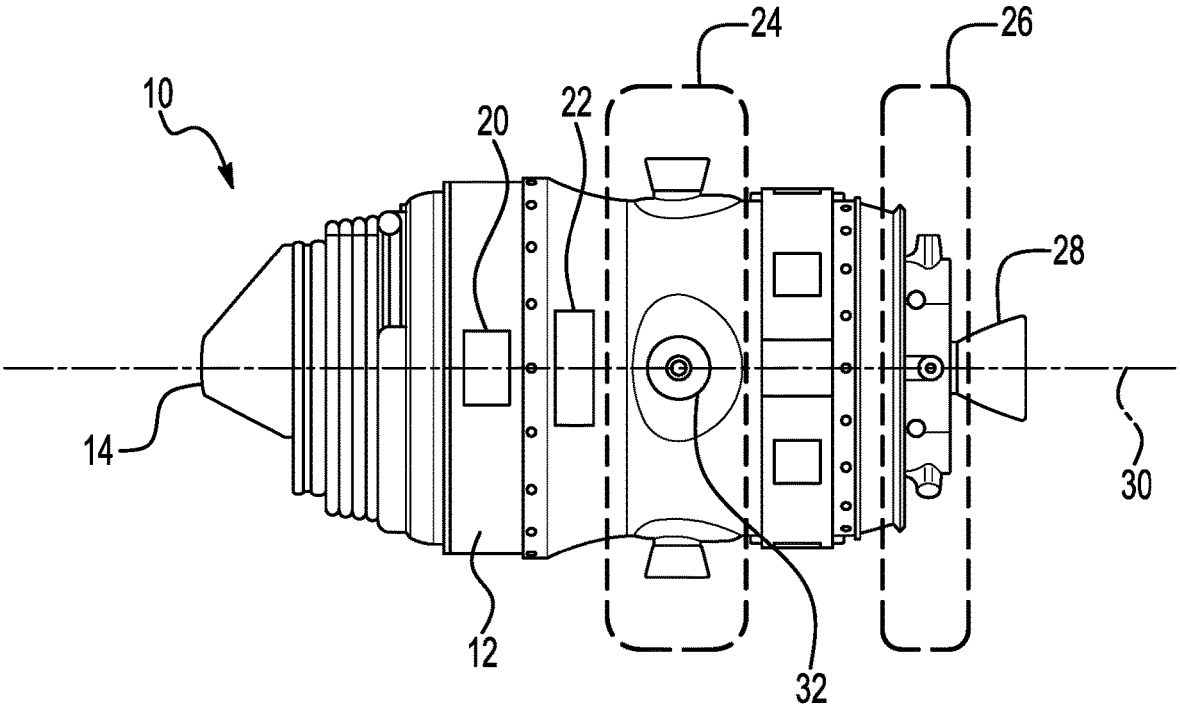
FIG. 1 is a side view of a kinetic energy vehicle according to an embodiment of the invention.

FIG. 1 shows a kinetic energy vehicle 10 used to collide with and neutralize a target vehicle, such as a ballistic missile, by destroying the target vehicle and/or changing course of the target vehicle. The vehicle 10 may be an exoatmospheric vehicle, capable of operating in space. The kinetic energy vehicle 10 (also referred to herein as a kinetic energy warhead) may be a standalone vehicle or may be initially part of a larger structure, for example a single rocket or missile having multiple kinetic energy vehicles or warheads that separate from one another in flight and may be directed to separate targets.

The vehicle 10 includes a body or housing 12, with a sensor 14 for tracking/seeking the target, which may be a target moving at a high speed, such as at a hypersonic speed, for example being a ballistic missile. The sensor 14 may be an optical, radar, infrared, or other type of sensor, used for tracking the target. The vehicle 10 may also have a communications system (not shown) for communicating information to an external station (either stationary or mobile) and/or for receiving information and/or instructions, such as for guidance of the vehicle 10.

The vehicle 10 has a guidance and control system 20 that is used for controlling flow of pressurized gasses produced by a rocket motor 22, to a series of thruster systems, a divert thruster system 24, an attitude control system 26, and an aft thruster 28. The rocket motor 22 may be a solid rocket motor system, with oxidizer and fuel combined in a burnable solid structure, which may be ignited using a suitable igniter for burning during flight. The control system 20 may be used to control flow of the pressurized gasses produced by combustion of the solid rocket fuel to the various thrusters of the systems 24 and 26, and the aft thruster 28. Suitable valves may be used to turn the flow of pressurized gasses to the various thrusters on and off. The term "valve" broadly refers to devices for controlling pressurized gas flow through thrusters, including for example throttleable thrusters using pintles to control gas flow.

The divert thruster system 24 is located in a central part of the vehicle 10, for example at a point along a longitudinal (axial) axis 30 of the vehicle substantially corresponding to a center of gravity 32 of the vehicle. By "substantially corresponding" it is meant that the axial location of the divert thruster system 24 may be the same as that of the center of gravity 32 to within 1% of the length of the vehicle 10. It will be appreciated that this is only an example value, and that the center of the of divert thruster system 24 may be closer to or further from the vehicle center of gravity 32, for example being within 0.1%, 0.2%, 0.5%, 2%, or 5% of the length of the vehicle 10.

The attitude control system 26 is located away from the center of gravity 32, so as to be able to provide pitch and roll moments to the vehicle 10. The system 26 is at (or close to) an aft end 34 of the vehicle 10 in the illustrated embodiment.

The aft thruster 28 may be along the longitudinal axis 30 of the vehicle 10, providing thrust in a substantially axial direction to drive the vehicle 10 forward. The aft thruster 28 may be used as part of the effort to steer/guide the vehicle 10, as described further below.

Figure 2A:
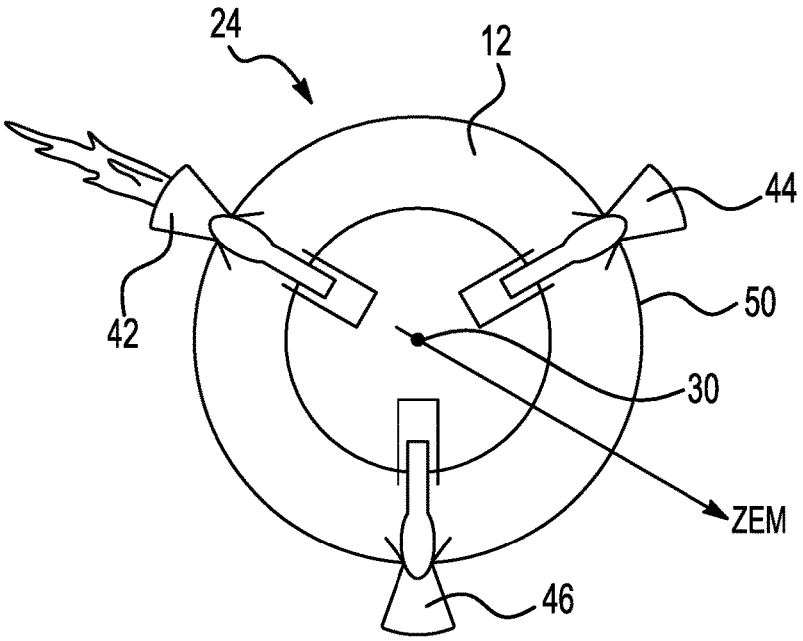
FIG. 2A is a cross-sectional view showing details of a divert thruster system of the vehicle of FIG. 1.

FIG. 2A shows details of one embodiment of the divert thruster system 24. The system 24 includes three divert thrusters 42, 44, and 46, which all may be substantially identical to one another. The divert thrusters 42-46 are located substantially evenly circumferentially spaced about a perimeter 50 of the vehicle body 12. By "substantially evenly circumferentially spaced" it is meant that the spacing is even to within 1 degree. Thus for the three divert thrusters 42-46 of the illustrated embodiment there may be 119-121 degrees about the perimeter between the thrusters 42-46. It will be appreciated that the circumferential spacing of the divert thrusters 42-46 may be more or less precise, for example the divert thrusters 42-46 being between 119.9 and 120.1 degrees apart from one another.

It is advantageous to reduce the number of divert thrusters, since the divert thrusters 42-46 are costly both in terms of price and in terms of weight. Further, reducing the number of divert thrusters may be seen as allowing addition of the aft thruster 28 (FIG. 1), essentially balancing the addition of the aft thruster 28 with the deletion of one of the standard cruciform-configuration divert thrusters.

One or more of the divert thrusters 42-46 may be activated (such as by opening a corresponding valve) to provide thrust in a desired direction or directions to provide a force to translate the vehicle 10. The vehicle 10 may be configured to rotate (roll) to align a single of the divert thrusters 42-46 with a desired direction of thrust, before activating the divert thrust. For example, the vehicle 10 may be configured to roll to align one of the divert thrusters 42-46, such as the closest of the divert thrusters 42-46, with a predicted zero-effort miss (ZEM) vector, a direction in which the vehicle 10 is to be translated so as to be on a path to collide with the target.

The vehicle 10 may be pre-oriented, such as by rolling using the attitude control system 26 (FIG. 1, described further below), to a favorable attitude based on predicted future maneuvers. For instance the vehicle 10 may be oriented for an expected aimpoint shift when the target initially becomes resolved.

Eliminating a divert thruster (from the prior art four-thruster cruciform configuration) and adding the aft axial thruster 28 (FIG. 1) increases flexibility for the vehicle 10 in engaging current threats, and possible threats that might occur in the future, such as maneuvering targets and/or targets that accelerate and/or decelerate axially. The use of the three divert thrusters 42-46 in combination with the aft axial thruster 28 enables Lambert guidance to control time-of-arrival capability.

Figure 2B:
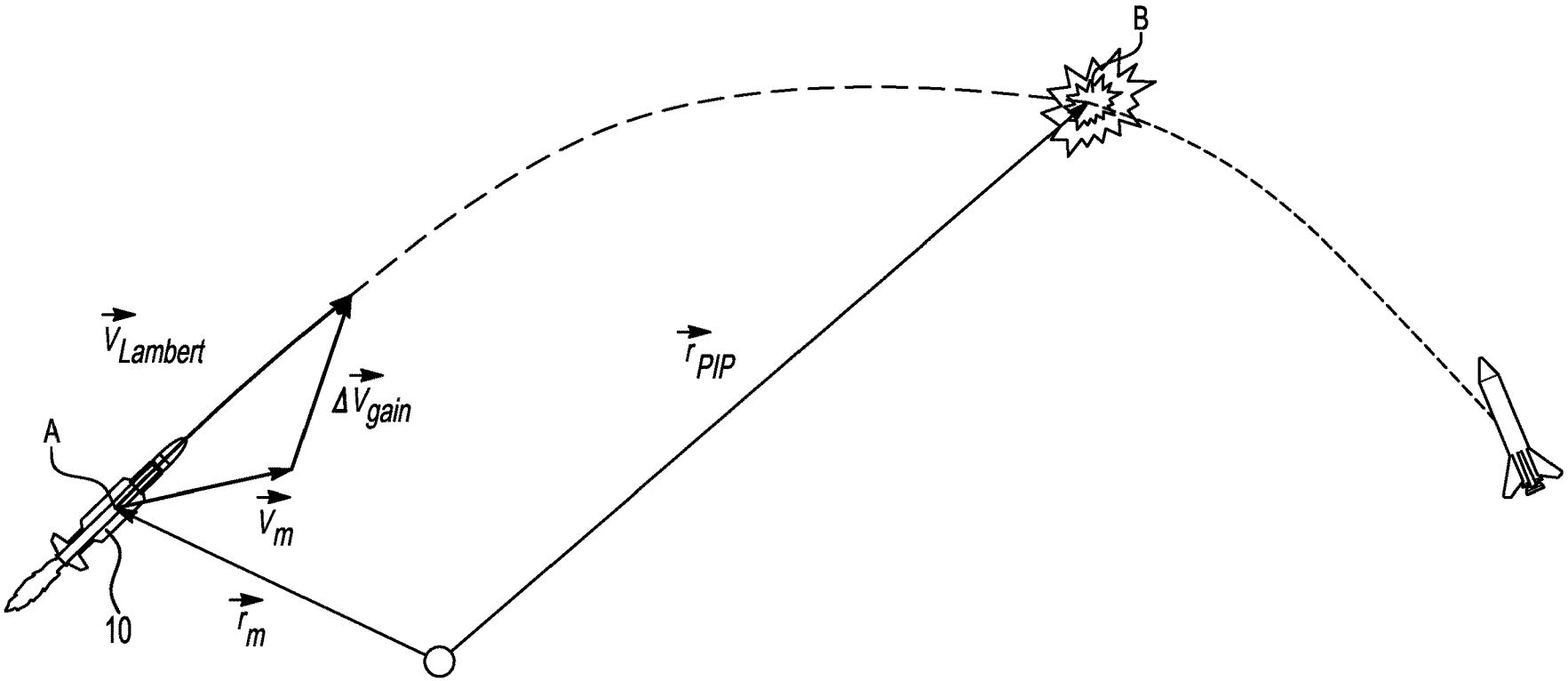
FIG. 2B is a diagram illustrating Lambert guidance, in accordance with an embodiment of the invention.

With reference now to FIG. 2B, such guidance approaches are well known, and involve adjusting a course of the projectile (the vehicle 10) presently at location A, to direct it to a predicted intercept point (PIP), indicated in FIG. 2B as location B, at a desired time of arrival or time of flight (TOF). For a projectile (missile) with a present vector velocity $V_m$, there is a desired vector velocity $V_{Lambert}$ to travel a projected parabolic trajectory. This involves a velocity gain $V_{gain}=V_{Lambert}-V_m$, to correct the course from the $r_m$ that the projectile would travel without correction, by a vector $r_{PIP}$ to cause it to reach the PIP at the TOF.

The $V_{Lambert}$ is a function of $r_m$, $r_{PIP}$, and TOF. The $V_{gain}$ is used to produce a commanded vector acceleration $a_{cmd}$ as follows:

$$\vec{a}_{cmd} = \frac{T}{m}\frac{\Delta\vec{V}_{gain}}{\|\Delta\vec{V}_{gain}\|} \tag{1}$$

where T is the thrust of the missile and m is the mass of the missile.

Figure 3:
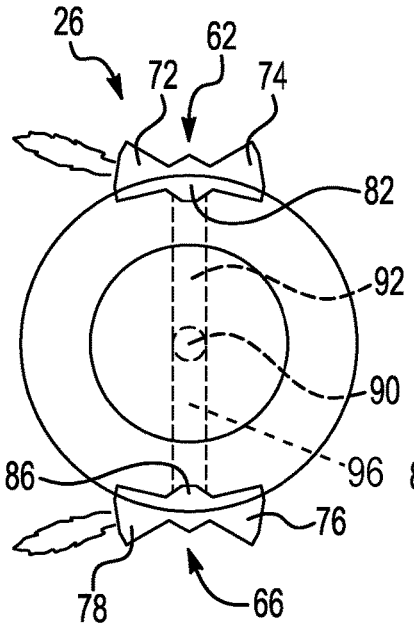
FIG. 3 is a cross-sectional view showing details of an attitude control system (ACS) of the vehicle of FIG. 1, with the ACS being operated to produce a yaw moment.
Figure 4:
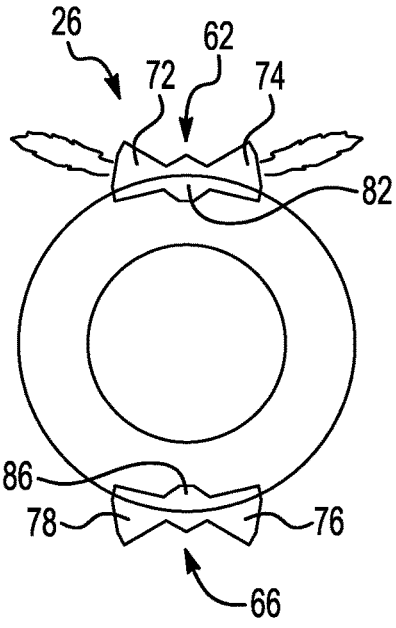
FIG. 4 is a cross-sectional view showing the ACS system of FIG. 3 being used to produce a pitch moment.
Figure 5:
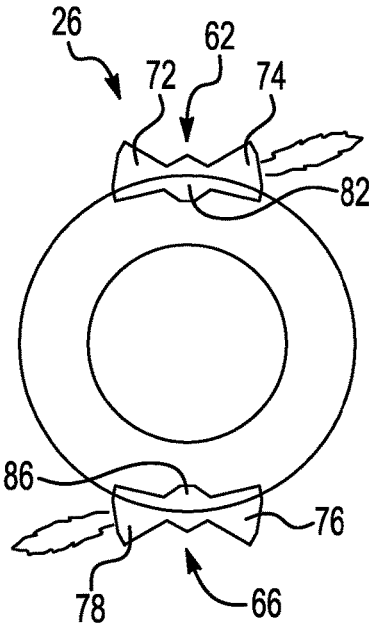
FIG. 5 is a cross-sectional view showing the ACS system of FIG. 3 being used to produce a roll moment.

Referring now to FIGS. 3-5, the attitude control system 26 includes two attitude control thruster pairs 62 and 66, with the pairs 62 and 66 diametrically opposed to one another on opposite sides of the vehicle 10. The pairs 62 and 66 may have substantially identical configurations, each having a "bowtie" configuration with a pair of thrusters oriented at angles to a perimeter of the vehicle body 12, with nonzero both radial and circumferential components of thruster when engaged.

The control thruster pair 62 is made up of attitude control thrusters 72 and 74, and the control thruster pair 66 is made up of attitude control thrusters 76 and 78. All of the individual thrusters 72 and 74 have radial and circumferential components to their thrust. In the illustrated embodiment the circumferential thrust components are greater than the radial components. The attitude control thrusters 72 and 74 have radial/lateral components in the same direction, and circumferential components in opposite directions. Similarly, the attitude control thrusters 76 and 78 have radial/lateral components in the same direction, and circumferential components in opposite directions. The radial/lateral thrust components of the attitude control thrusters 72 and 74 are in an opposite direction from those of the attitude control thrusters 76 and 78.

The angles of the attitude control thrusters 72-78 may all be substantially the same, for example within 0.1, 0.2, 0.5, 1, 2, 5, or 10 degrees. The thrust output by the attitude control thrusters 72-78, the radial thrust components and/or the circumferential thrust components, may all be substantially the same, for example within 0.1%, 0.2%, 0.5%, 1%, 2%, 5% or 10%.

The paired configuration of the attitude control thrusters 72-78 may make the attitude control system 26 more compact, with less weight and lower cost, relative to prior attitude control systems having separate attitude control thrusters. Cost and weight savings may also be achieved relative to prior systems having a greater number of attitude control thrusters, for example relative to prior systems having six thrusters.

The control thruster pair 62 is coupled to, such as being mounted in, a manifold 82. The control thruster pair 66 is coupled to, such as being mounted in, a manifold 86. Pressurized gasses from the rocket motor 22 (FIG. 1) may pass through a flow passage 90 that splits into flow passages 92 and 96, which provide gasses to the manifolds 82 and 86, respectively.

The attitude control thrusters 72-78 may be actuated (fired) in various pairs to achieve desired yaw, pitch, and roll adjustment of the vehicle 10. FIG. 3 shows a yaw adjustment using the thrusters 72 and 78. FIG. 4 shows a pitch adjustment using the thrusters 72 and 74. FIG. 5 shows a roll adjustment using the thrusters 74 and 78. It will be appreciated that various combinations of the thrusters 72-78 may be fired to achieve a wide range of desired combinations of yaw, pitch, and roll, either individually or simultaneously.

In an alternate embodiment (not shown), the aft axial thruster 28 may be omitted. Also, it will be appreciated that the different thruster configurations may be substituted for either of the three-divert-thruster configuration or the "bowtie" attitude control thruster configurations described above.

Figure 6:
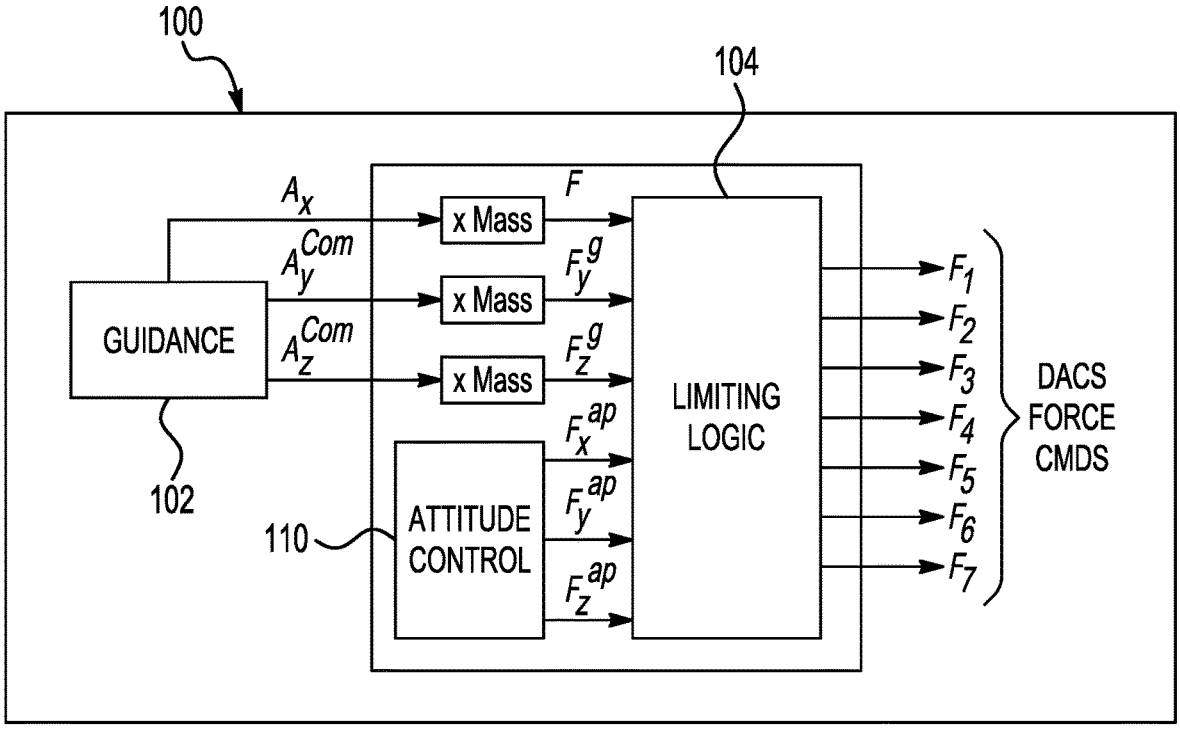
FIG. 6 is a block diagram showing a divert and attitude control system (DACS) control loop of the vehicle of FIG. 1.

FIG. 6 is a block diagram of a divert and attitude control system (DACS) control loop or autopilot 100. Guidance commands are input from a guidance block 102 into limiting logic 104. The guidance blocks issues acceleration commands to the autopilot 100 to put the vehicle 10 (FIG. 1) on a collision course with a target, such as by removing the zero-effort miss or heading error. the role of the autopilot 100 is to simultaneously 1) control the attitude of the vehicle 10 to main stability of the airframe, and 2) issue commands to the actuation system (the DACS) to produce the accelerations requested by the guidance. The limiting logic 104 receives command torques from an attitude control block 110, which is described in greater detail below. In general the attitude control block 110 ensures that the vehicle 10 maintains a proper orientation (pitch, yaw, and roll) in order to keep the target within the vehicle's field of view. As described further below its algorithm may use various combinations of proportional, integral, and derivative (PID) control laws or other forms of feedback/feedforward control laws. The limiting logic 104 produces DACS force commands $F_1$-$F_7$ that are used to command thrust from the various thrusters of the divert thruster system 24 (FIG. 1) and the attitude control system 26 (FIG. 1). The limiting logic 104 determines the DACS force commands to provide the requested guidance accelerations (forces) to maintain the desired attitude (corresponding to torques for correcting attitude), as well as limiting the commands to observe DACS capabilities. All of the components of the control loop/system 100 may be the same as in legacy or prior art systems, those with more conventional arrangements of divert and attitude control thrusters, with the exception of the limiting logic 104, which may be modified to accommodate the novel arrangements of attitude control and divert thrusters.

Figure 7:
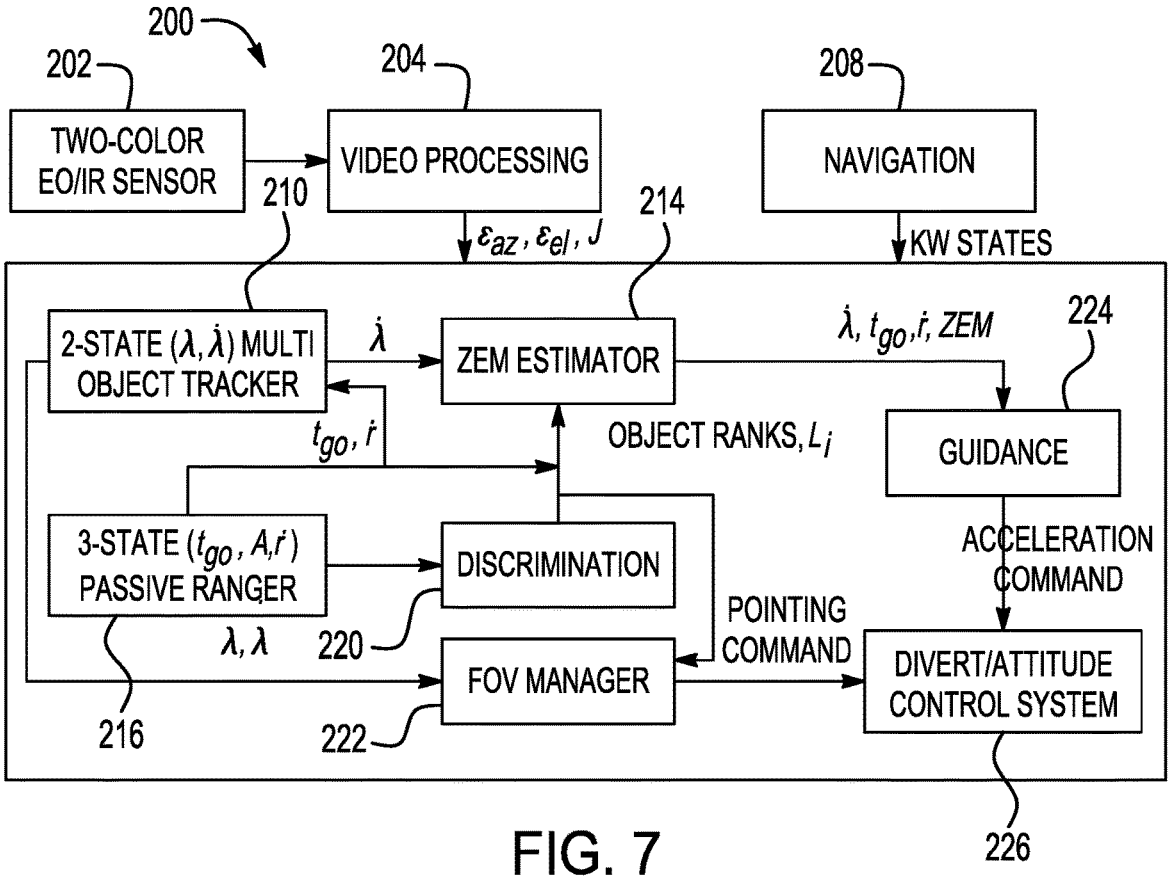
FIG. 7 is a block diagram of an algorithm architecture of the vehicle of FIG. 1.

FIG. 7 shows a block diagram of an algorithm architecture 200 for the attitude control block 110 (FIG. 6). In an EO/IR sensor block 202 data is received/collected at an electro-optical/infra-red (EO/IR) sensor, such as the sensor 14 (FIG. 1). IR energy collected at the sensor 14 is used to create a radiance image that captures contributions from IR sources in an environment, including IR emitted from the threat (target). The IR sensor of an EO/IR sensor may be the primary way to locate and track the target (threat) in angular/azimuth/elevation space with respect to the vehicle 10, which allows placing and keeping the vehicle 10 on a course to collide with the target. Many alternative types of sensors may be used.

A video processing subsystem 204 is a set of algorithms that may be embodied in software (but alternatively in part or in whole in hardware) that take the radiance image from the EO/IR sensor block 202, and convert the image to a set of detections that other algorithms to use in tracking/targeting, such as a multi-object tracker 210 described further below. The detections can be as small as a single pixel (when the target is far away and unresolved), or may constitute a cluster of pixels when the target is closer and resolved.

A navigation subsystem 208 computes the kinetic energy vehicle's position, velocity, and attitude (orientation), for instance using one or more onboard inertial measurement units (IMUs). Other navigation devices may also be used, such as a global positioning device (GPS) receiver and an associated algorithm, such as a Kalman filter algorithm. As another possibility a visible EO sensor can be used in conjunction with a star tracker as an aiding source.

The multi-object tracker 210 converts detections from the video processing subsystem 204 into sets of observations, or tracks, that are produced by IR-emitting objects in the environment. The tracker 210 validates such tracks by screening out background clutter and noise. The tracker 210 may also provide estimates of the present and predicted future locations of objects such as threats or targets. A state of the object relative to the vehicle 10 (FIG. 1) may be estimated in terms of a line-of-sight (LOS) angle from the vehicle 10 to the object, and a time derivative of the LOS angle. The LOS angle and LOS angle derivative may be estimated by use of a Kalman filter on the incoming data.

A zero-effort miss (ZEM) estimator block 214 computes a predicted miss distance that must be removed by adjusting flight (course/orientation) of the vehicle 10 (FIG. 1). The ZEM vector may be computed based on the assumption that the threat (target) follows ballistic missile dynamics. The ZEM estimate may also be augmented with or take into account DACS delays and/or guidance/control loop latencies.

A passive range estimator subsystem 216 uses additional measurements from the EO/IR sensor 202 to estimate time-to-go (TTG) to various IR objects that have been detected in the environment. The TTG is the time required for an object, e.g., the vehicle 10 (FIG. 1), to reach a certain location, for example the collision point with the object. The passive range estimator 216 may be able to estimate TTG when a threat becomes resolved and the detected pixels are clustered in regions greater than one pixel. This detected area of clustered pixels increases with range closure, from which the TTG can be inferred.

Figure 8:
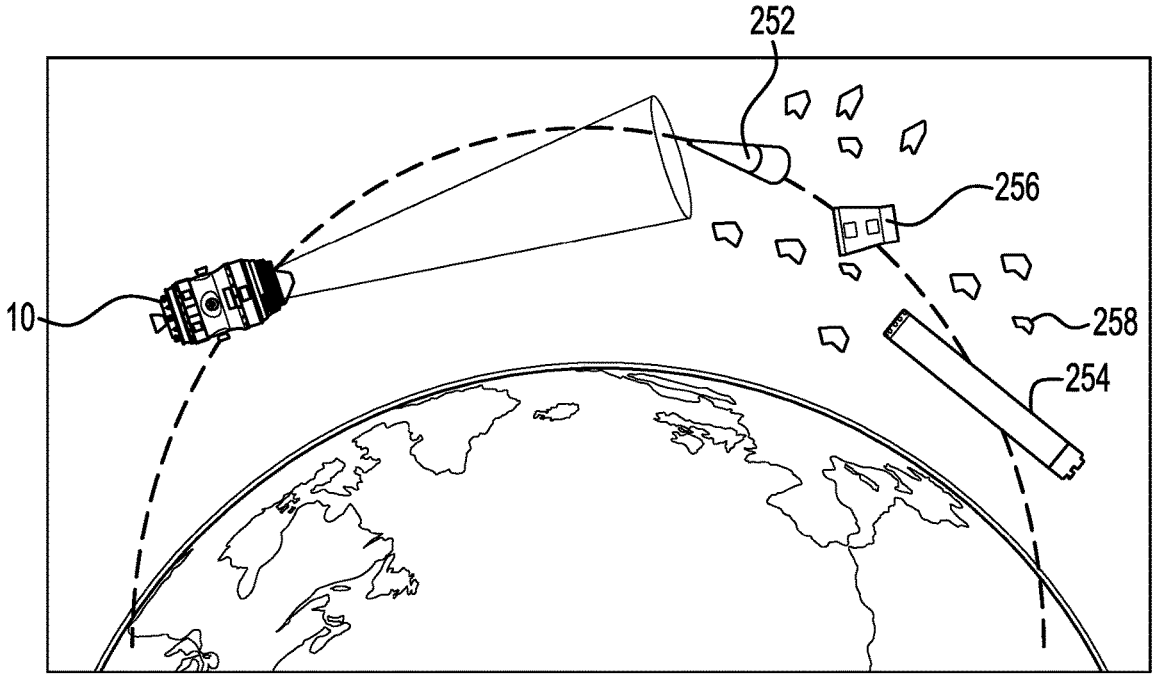
FIG. 8 is a schematic diagram illustrating a discrimination process performed by the vehicle of FIG. 1.

A discrimination block 220 determines which detected object in the IR environment is the threat of interest. This may be done through any of a variety of known criteria and/or methods. The discrimination is illustrated in FIG. 8, where the kinetic energy vehicle 10 needs to discriminate between a true target 252, and other items such as a booster 254, an attitude control module (ACM) 256, and various pieces of debris 258.

A field of view (FOV) manager 222 receives input from the discrimination block 220, maintains objects of interest within the FOV as the kinetic vehicle approaches the target, avoids sources of interference such as the sun/moon and other resident space objects, and provides a pointing command to a divert/attitude control system (DACS) 226. The FOV manager subsystem 22 maintains objects of interest within the FOV as the vehicle 10 (FIG. 1) approaches the target, avoids sources of interference such as the sun/moon and other resident space objects, and provides a pointing command to a divert/attitude control system (DACS).

A guidance subsystem 224 also provides input to the DACS 226. The guidance subsystem 224 may use a hedging guidance law prior to threat selection by the discrimination block 220. After target selection the guidance block 224 may use conventional ZEM guidance for guiding and altering course of the vehicle 10 (FIG. 1). Throughout flight the guidance subsystem 224 also may manage a state machine of the vehicle 10. The state machine defines the various transitions between the software functional flow (for example the kinetic vehicle begins in the state of searching for the target, then transitions to the state of acquiring the target, then transitions to the state of tracking the target, and finally to intercepting the target).

The DACS 226 has been described above in detail with regard to FIGS. 1-5. The DACS 226 and the associated control laws ensure that the vehicle 10 (FIG. 1) simultaneously points at the target and is guided to the target in an efficient manner. Conventional proportional-integral-derivative (PID) controllers may be used in controlling the elements (thrusters) of the DACS 226, or other types of controllers, such as a more modern control architecture, may be employed.

Figure 9:
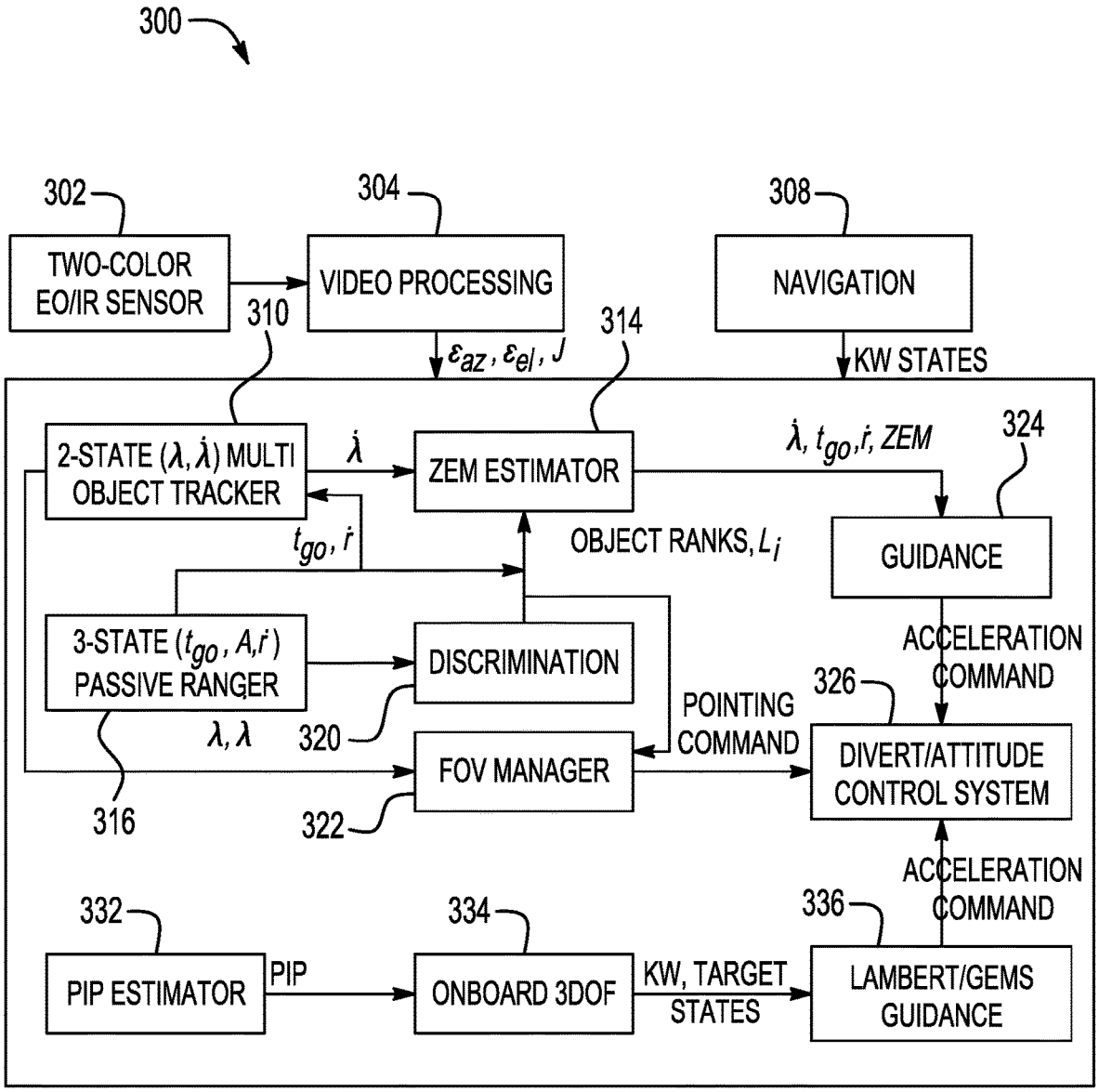
FIG. 9 is a block diagram of an alternative algorithm architecture usable with the vehicle of FIG. 1.

FIG. 9 shows an alternative control architecture 300 that employs blocks/systems/subsytems 302-326 that are similar to those described with regard to the architecture or algorithm 200 (FIG. 7), similar elements having reference numbers shifted by 100. In addition the control architecture 300 has additional elements 332, 334, and 336 that make use of an aft axial thruster, such as the thruster 28 (FIG. 1), in guidance of a vehicle such as the vehicle 10 (FIG. 1). The additional elements include a predicted impact point (PIP) estimator 332, an onboard three-degree-of-freedom (3DOF) estimator 334, and a Lambert/general energy management system (GEMS) guidance subsystem 336. The PIP estimator 332 may provide updated and more accurate estimates of a PIP. An axial burn during a boost phase of flight may be used to cover large and dynamic PIP uncertainty error volume.

Figure 10:
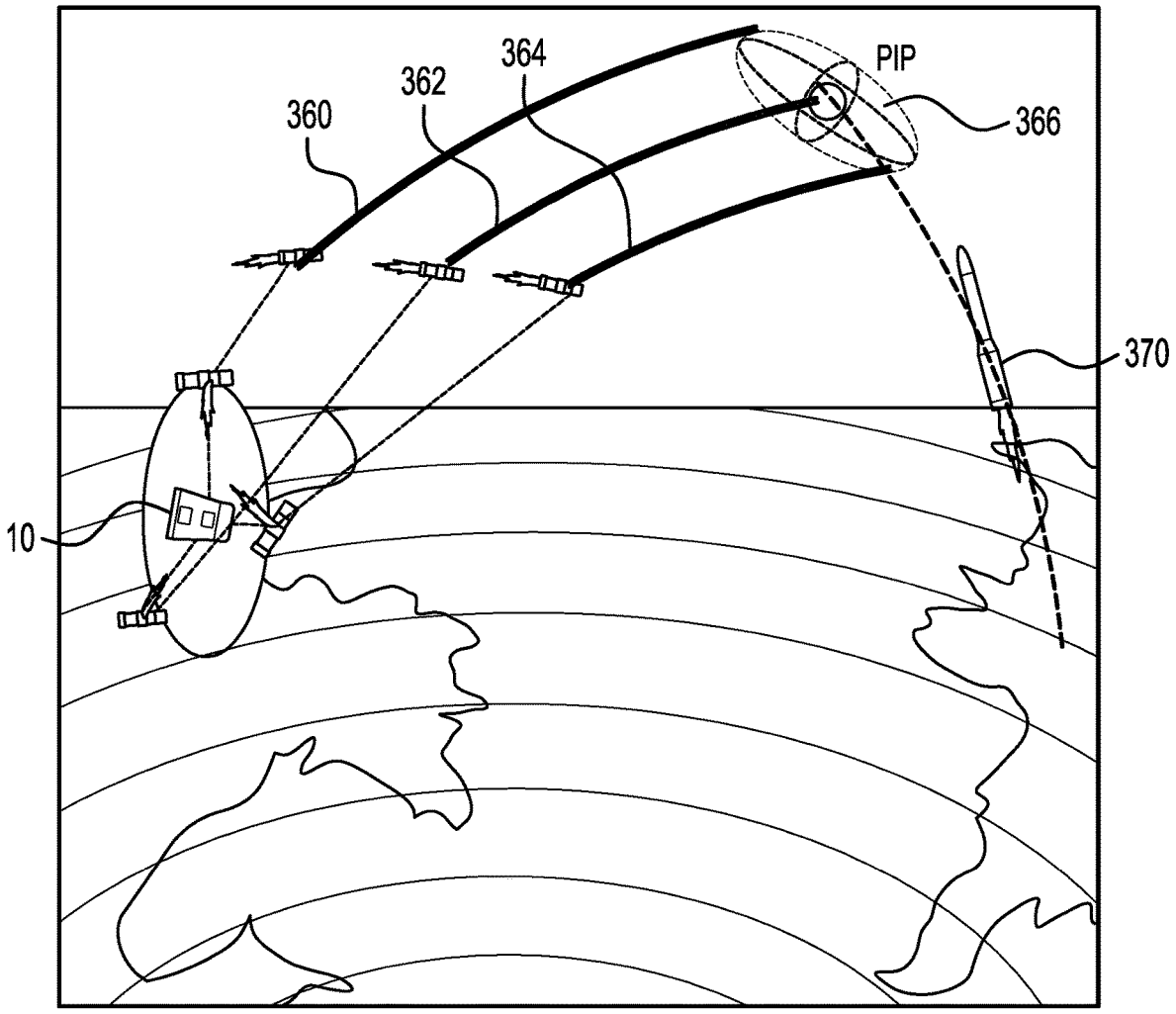
FIG. 10 is a schematic diagram illustrating one possible use of the axial thruster of the vehicle of FIG. 1.

Alternatively, as illustrated in FIG. 10, with three possible flight paths 360, 362, and 364 for respective vehicles 350, 352, and 354 are shown, all toward different points in an uncertain PIP region 366 for impacting a target 370. vehicles 350-354 emerge and separate from a mother ship 348. The mother ship 348 is used to initially move the vehicles 350-354 toward the target region 366, prior separation of the vehicles 350-354 from the mother ship 348. The vehicles 350-354 each have their own maneuvering systems, which may include respective axial motors, and cover different portions of the uncertain PIP region 366.

Figure 11:
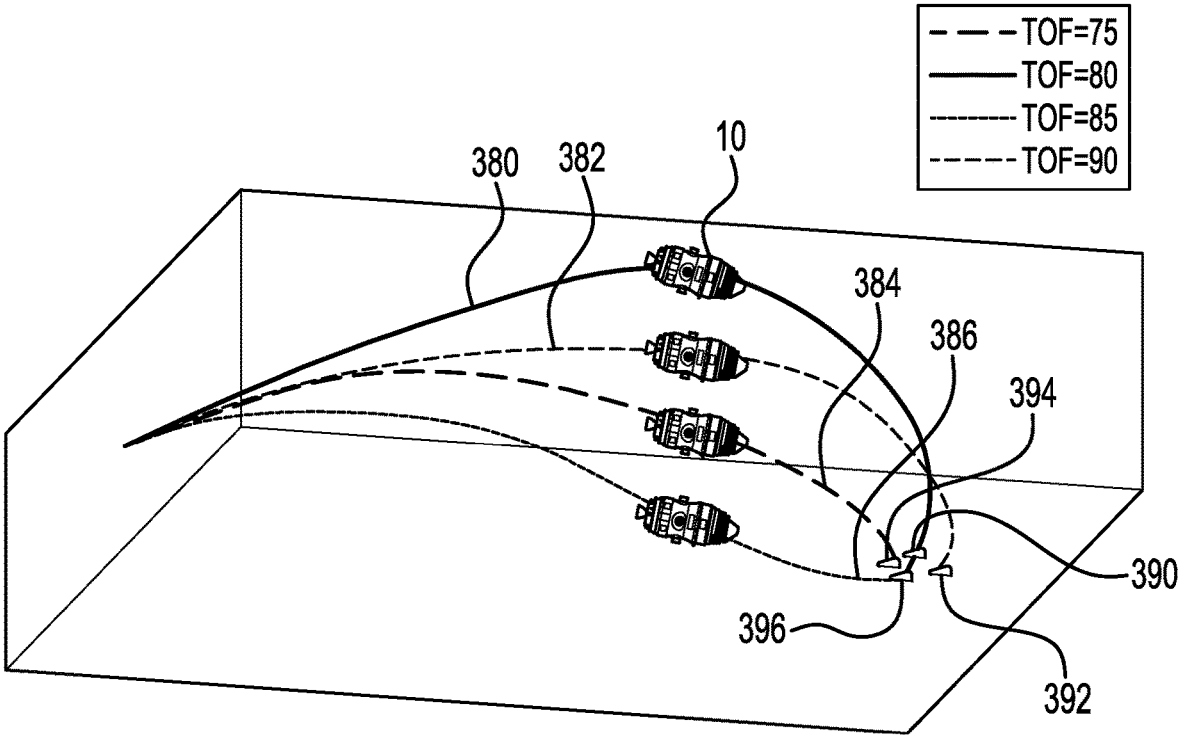
FIG. 11 is a schematic diagram illustrating another possible use of the axial thruster of the vehicle of FIG. 1.
Figure 12:
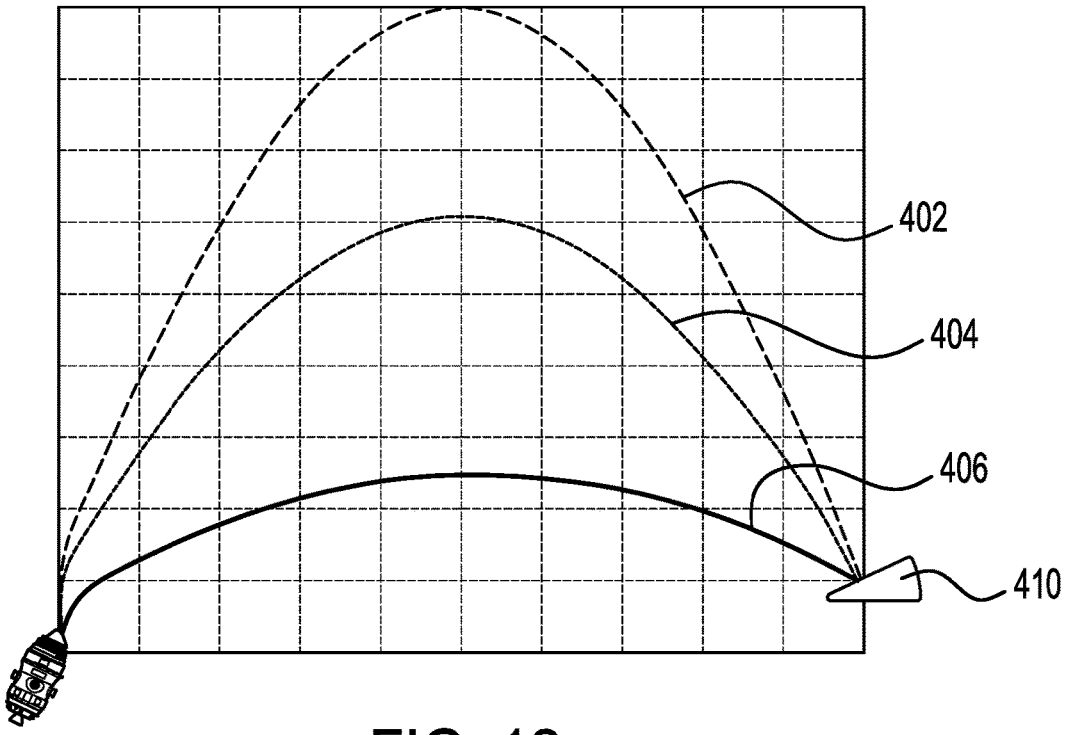
FIG. 12 is a graph illustrating still another possible use of the axial thruster of the vehicle of FIG. 1.

With reference now in addition to FIGS. 11 and 12, the axial thruster 28 (FIG. 1) may also (or alternatively) be used in ascent/midcourse to modify the time of flight (TOF) and coordinate attack against raid targets, such as any of multiple targets that are part of a single operation. FIG. 11 shows possible flight paths 380, 382, 384, and 386, corresponding to respective potential targets 390, 392, 394, and 396. Different vehicles may be used to engage the different targets 390-396 simultaneously, or at different times. An advantage to engaging the targets 390-396 at different times is that there is less interference, such as interference for IR sensors, than if the targets 390-396 were engaged simultaneously.

FIG. 12, a conceptual graph of altitude versus downfield distance, shows three possible paths 402, 404, and 406 to a target 410, with different times of flight. The path 402 has the minimum TOF and the paths 404 and 406 have longer times of flight. In the guidance described earlier with regard to FIG. 2B there are many possible paths to the target, for example with different TOFs. An axial thruster may be fired at different times, for different durations, and/or with different levels of thrust or a different thrust profile, to vary the path and TOF. Burns of the axial thruster 28 may provide flexibility in engaging threats. Such flexibility may be advantageous for many reasons. To give one example, it may be advantageous to vary the time of arrival to hit the target when the target is within a flight constraint of the vehicle 10 (FIG. 1), for instance when the target is at a sufficient (or desired) altitude, so as to avoid heating of an IR sensor, for example.

To give another example, it may be desirable to adjust the course of the vehicle 10 (FIG. 1) for any of various reasons. For instance it may be advantageous to avoid orientations of the vehicle 10 which have an IR sensor pointed at the sun or moon.

Some of the methods/blocks/subsystems described above may be implemented in any of a variety of ways, for example as software executed on a processor or other device, and/or as hardware, such as a processor, field-programmable gate array (FPGA), integrated circuit, or the like.

As used herein, software includes but is not limited to, one or more computer or processor instructions that can be read, interpreted, compiled, and/or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software also may be implemented in a variety of executable or loadable forms including, but not limited to, a stand-alone program, a function call (local or remote), a servlet, and an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or computer-executable instructions can be located in one logic or distributed between two or more communicating, co-operating, or parallel processing logics and thus can be loaded or executed in series, parallel, massively parallel and/or other manners.

In addition to the aforementioned description, in other embodiments, elements discussed in this specification may be implemented in a hardware circuit(s) or a combination of a hardware circuit(s) and a processor or control block of an integrated circuit executing machine readable code encoded within a computer readable media. As such, the term circuit, module, server, application, or other equivalent description of an element as used throughout this specification is, unless otherwise indicated, intended to encompass a hardware circuit (whether discrete elements or an integrated circuit block), a processor or control block executing code encoded in a computer readable media, or a combination of a hardware circuit(s) and a processor and/or control block executing such code.

Figure 13:
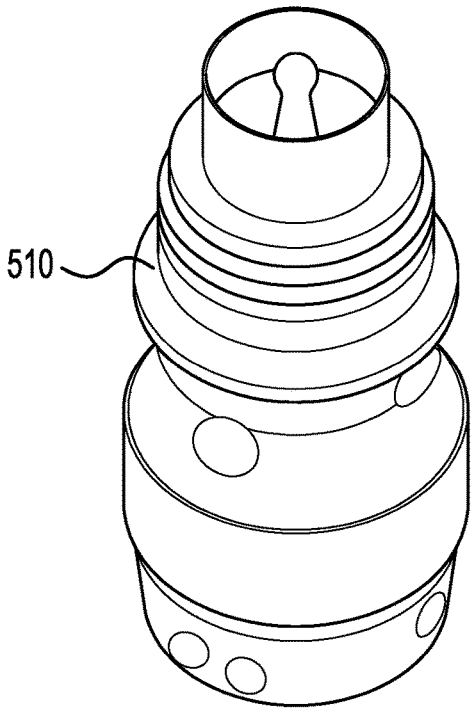
FIG. 13 is an oblique view showing a stand-alone kinetic energy vehicle.
Figure 14:
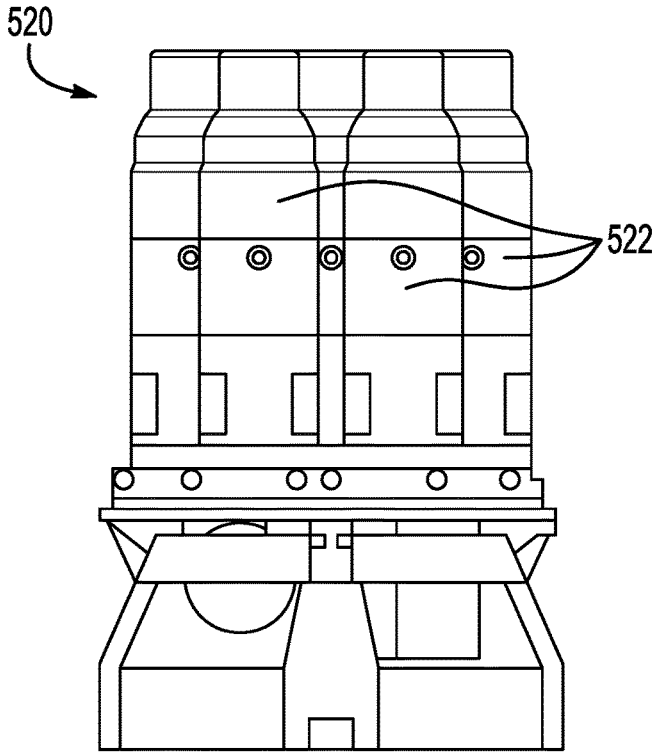
FIG. 14 is an oblique view showing a weapon that includes multiple separable kinetic energy vehicles.

The vehicle 10 (FIG. 1) may be used as a unitary stand-alone kinetic energy vehicle, or may be used as part of a weapon that has multiple kinetic energy vehicles. FIG. 13 shows a single unitary kinetic energy vehicle 510, while FIG. 14 shows a weapon 520 that includes multiple separable kinetic energy vehicles 522. The kinetic energy vehicles, whether alone or as part of a larger weapon, may be launched from land, sea, air, or space. There may be booster rockets (not shown) for initially accelerating the kinetic energy vehicle(s) and causing the vehicle(s) to ascend toward a point at which tracking and closing with a target threat as described above is initiated.

Figure 15:
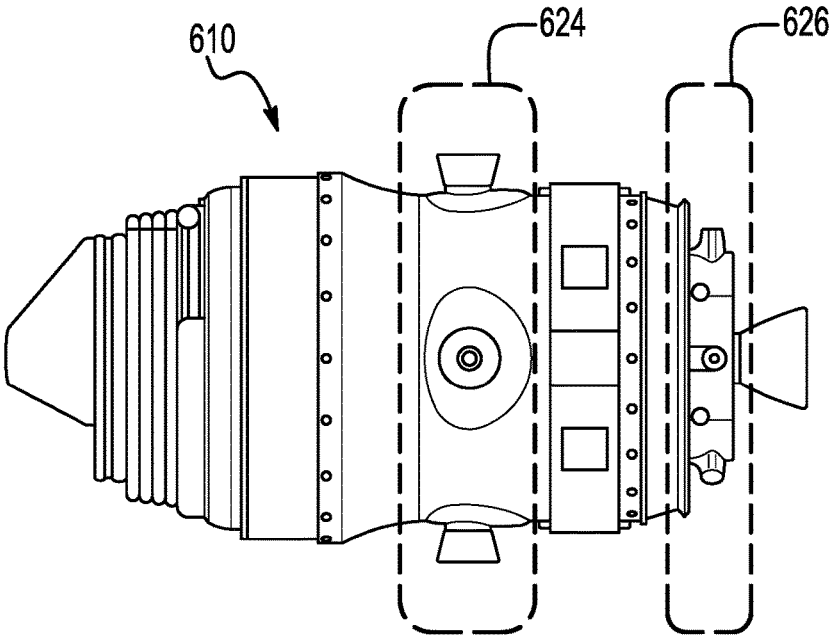
FIG. 15 is a side view of a kinetic energy vehicle according to another embodiment of the invention.
Figure 16:
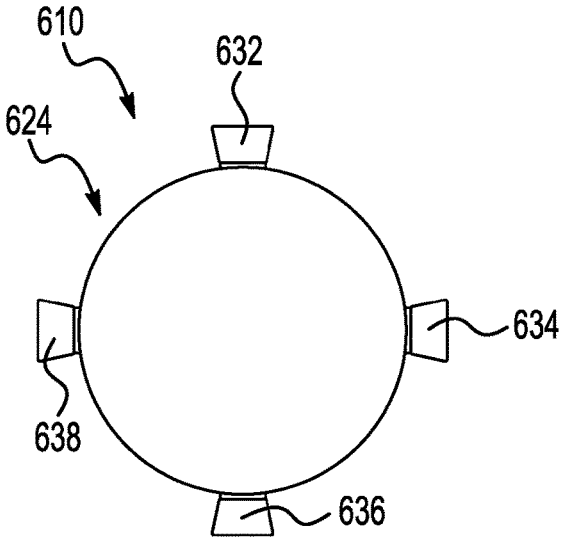
FIG. 16 is a cross-sectional view showing details of an attitude control system (ACS) of the vehicle of FIG. 15.

FIGS. 15 and 16 shows an alternative vehicle 610 that has a diverter thruster system 624 that is of a more conventional configuration, having four divert thrusters 632, 634, 636, and 638 in a cruciform configuration, combined with an attitude control system 626 that has the same configuration as the attitude control system 26 (FIG. 1) described above with regard to FIGS. 1 and 3-5. In the illustrated embodiment the vehicle 610 has four of the divert thrusters 632-638 and no aft thruster like the thruster 30 (FIG. 1) of the vehicle 10 (FIG. 1). Alternatively the vehicle 610 may have an additional aft thruster.

Figure 17:
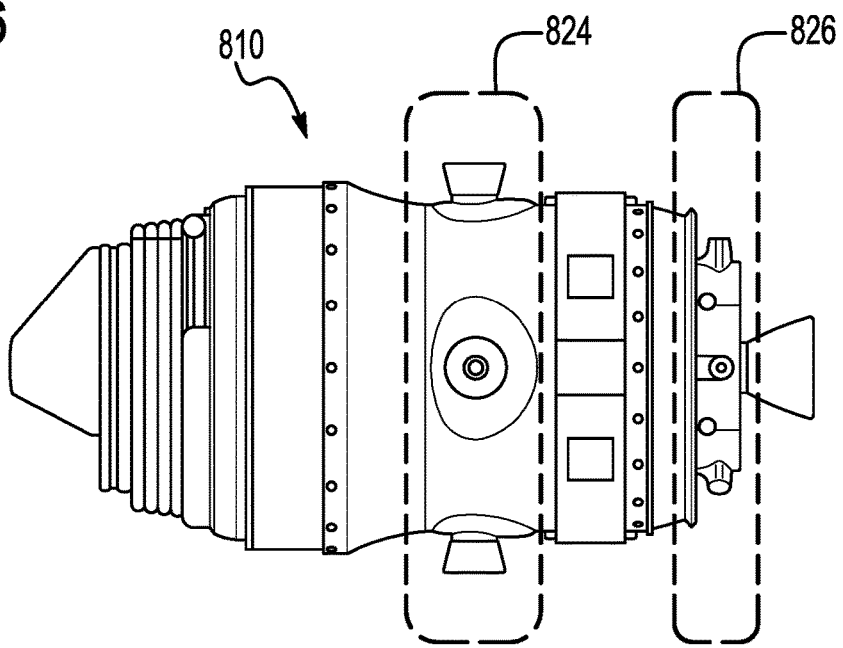
FIG. 17 is a side view of a kinetic energy vehicle according to yet another embodiment of the invention.
Figure 18:
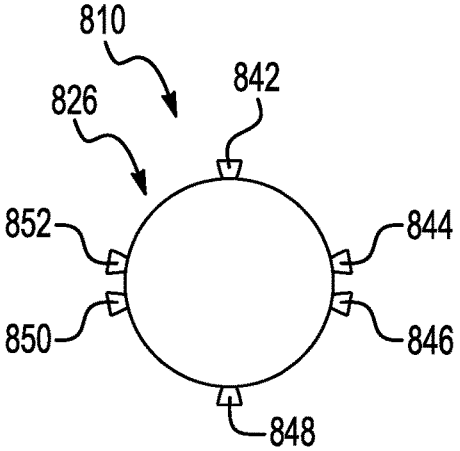
FIG. 18 is a cross-sectional view showing details of a divert thruster system of the vehicle of FIG. 17.

FIGS. 17 and 18 show an alternative vehicle 810 that has a divert thruster system 824 and an aft thruster 830 similar to the divert thruster system 24 (FIG. 1) and the aft thruster 30 (FIG. 1) described above with regard to the vehicle 10 (FIG. 1). The vehicle 810 combines the divert thruster system 824 with a more conventional attitude control system 826 at its aft end. The attitude control system 826 includes six thrusters 842, 844, 846, 848, 850, and 852, as shown in FIG. 18. The thrusters 842-852 are capable of creating pitch, yaw, and roll moments, by being selectively fired as necessary.

Figure 19:
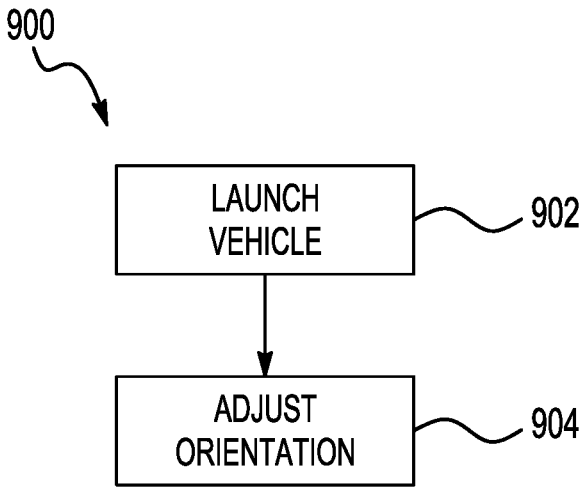
FIG. 19 is a high-level flow chart of steps of a method of flying a kinetic energy vehicle, according to an embodiment of the invention.

FIG. 19 shows a method 900 of flying a kinetic energy vehicle according to some embodiments described herein. The method 900 includes, in step 902, launching the kinetic energy vehicle, and in step 904 adjusting orientation by selectively actuating attitude control thrusters of kinetic energy vehicle to produce pitch, yaw, and roll moments. The attitude control thrusters used in the step 904 are in two pairs of attitude control thrusters, with one pair diametrically opposed to the other pair, and with the attitude control thrusters each pair having radial thrust components in an outward radial direction and circumferential thrust components in opposite circumferential directions.

Figure 20:
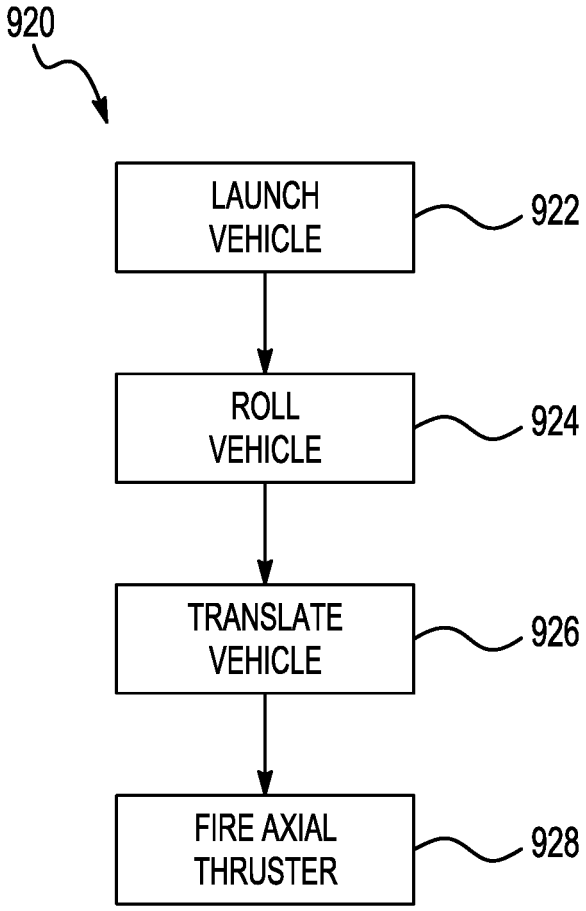
FIG. 20 is a high-level flow chart of steps of a method of flying a kinetic energy vehicle, according to another embodiment of the invention.

FIG. 20 shows a method 920 of flying a kinetic energy vehicle according to some embodiments described herein. In step 922 the kinetic energy vehicle is launched. In step 926 the kinetic energy vehicle the vehicle is translated using a divert thruster system of the kinetic energy vehicle, where the three divert thrusters are circumferentially substantially evenly spaced about a perimeter of the vehicle. Prior to that, in step 924, an attitude control system of the vehicle may be used to roll the vehicle, to align one of the divert thrusters with a desired direction of translation. The attitude control system and the divert thruster system are both coupled to a controller that controls rolling and translating of the vehicle. Also (and optionally), in step 928 course of the vehicle may be changed using an aft axial thruster of the vehicle that is also operatively coupled to the controller. These steps may be performed repeatedly, and in a variety of different sequences.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A kinetic energy vehicle comprising:

a solid rocket motor;

a divert thruster system; and an attitude control system;

wherein the divert thruster system and the attitude control system are operatively coupled to the solid rocket motor to receive pressurized gasses output by the solid rocket motor;

wherein the attitude control system includes two pairs of attitude control thrusters, with one pair diametrically opposed to the other pair, and with the attitude control thrusters of each pair having radial thrust components in an outward radial direction and circumferential thrust components in opposite circumferential directions; and wherein a first flow passage provides pressurized gas from the solid rocket motor to the attitude control thrusters of one of the pairs of attitude control thrusters; and wherein a second flow passage provides pressurized gas from the solid rocket motor to the attitude control thrusters of another of the pairs of attitude control thrusters.

2. The vehicle of claim 1, wherein for all of the attitude control thrusters the radial thrust component is nonzero and the circumferential thrust component is nonzero.

3. The vehicle of claim 2, wherein for each of the attitude control thrusters the circumferential thrust component is greater than the radial thrust component.

4. The vehicle of claim 1, wherein the radial thrust components of all of the attitude control thrusters are substantially the same.

5. The vehicle of claim 1, wherein the magnitude of the circumferential thrust components are all substantially the same.

6. The vehicle of claim 1, wherein the first flow passage provides pressurized gas to a first manifold that is mechanically coupled to the attitude control thrusters of the one of the pairs of attitude control thrusters; and wherein the second flow passage provides pressurized gas to a second manifold that is mechanically coupled to the attitude control thrusters of the another of the pairs of attitude control thrusters.

7. The vehicle of claim 1, further comprising a control loop operatively coupled to the divert thruster system and the attitude control system;

wherein the control loop provides commands regarding the thrust needed at the attitude control thrusters and at divert thrusters of the divert thruster system.

8. The vehicle of claim 7, wherein the control loop includes a mixing/limiting logic block that receives input from an autopilot, from a guidance system, and from an attitude control block.

9. The vehicle of claim 1, further comprising a sensor operatively coupled to the divert thruster system and the attitude control system.

10. The vehicle of claim 9, wherein the sensor is an electro-optical/infra-red (EO/IR) sensor.

11. The vehicle of claim 1, wherein the vehicle is an exoatmospheric vehicle.

12. The vehicle of claim 1, wherein the divert thruster system includes three divert thrusters circumferentially substantially evenly spaced about a perimeter of the vehicle.

13. The vehicle of claim 1, wherein the divert thruster system includes divert thrusters located longitudinally substantially at a center of gravity of the vehicle; and wherein the attitude control thrusters are aft of the divert thrusters, at an aft end of the vehicle.

14. The vehicle of claim 1, wherein a combined flow passage from the solid rocket motor splits into the first flow passage and the second flow passage.

15. The vehicle of claim 1, further comprising an axially-aligned thruster operatively coupled to the solid rocket motor to receive pressurized gasses output by the solid rocket motor.

16. A kinetic energy vehicle comprising:

a solid rocket motor;

a divert thruster system;

an attitude control system; and an axially-aligned thruster operatively coupled to the solid rocket motor to receive pressurized gasses output by the solid rocket motor;

wherein the divert thruster system and the attitude control system are operatively coupled to the solid rocket motor to receive pressurized gasses output by the solid rocket motor; and wherein the attitude control system includes two pairs of attitude control thrusters, with one pair diametrically opposed to the other pair, and with the attitude control thrusters of each pair having radial thrust components in an outward radial direction and circumferential thrust components in opposite circumferential directions.

17. The vehicle of claim 16, wherein the axially-aligned nozzle is coincident with a central longitudinal axis of the kinetic energy vehicle.

18. A method of flying a kinetic energy vehicle, the method comprising:

launching the kinetic energy vehicle; and adjusting orientation by selectively actuating attitude control thrusters of kinetic energy vehicle to produce pitch, yaw, and roll moments;

wherein the attitude control thrusters are in two pairs of attitude control thrusters, with one pair diametrically opposed to the other pair, and with the attitude control thrusters each pair having radial thrust components in an outward radial direction and circumferential thrust components in opposite circumferential directions; and wherein the adjusting orientation includes providing pressurized gasses from a solid rocket motor of the vehicle to one of the pairs of attitude control thrusters through a first flow passage, and providing pressurized gasses from the solid rocket motor to another of the pairs of attitude control thrusters through a second flow passage.

19. The method of claim 18, further comprising translating the vehicle during flight using divert thrusters of a divert thruster system of the vehicle.

20. The method of claim 19, wherein the divert thruster system includes three divert thrusters circumferentially substantially evenly spaced about a perimeter of the vehicle; and wherein the translating includes rolling the vehicle to position one of the divert thrusters to a desired translation direction.

* * * * *